United States Patent [19]

Tippmer et al.

[11] 4,099,929

[45] Jul. 11, 1978

[54] METHOD OF REMOVING ASH COMPONENTS FROM HIGH-ASH CONTENT COALS

[75] Inventors: Kurt Tippmer, Recklinghausen; Hubert Schmitt, Bochum; Heinrich Vinke, Recklinghausen; Georg Abendroth, Dülmen, all of Germany

[73] Assignee: Firma Carl Still Recklinghausen, Germany

[21] Appl. No.: 776,870

[22] Filed: Mar. 11, 1977

[30] Foreign Application Priority Data

Mar. 19, 1976 [DE] Fed. Rep. of Germany ..... 2611619

[51] Int. Cl.[2] ..... C10L 9/00; C10J 3/00

[52] U.S. Cl. ..... 44/1 F; 44/1 R; 48/210; 75/91; 209/11

[58] Field of Search ..... 44/1 R, 4, 1 F; 75/2, 75/6; 201/17; 209/9, 11

[56] References Cited

U.S. PATENT DOCUMENTS

| | | | |
|---|---|---|---|
| 2,808,369 | 10/1957 | Hickey | 201/17 X |
| 3,472,622 | 10/1969 | Ridley | 201/17 X |
| 3,993,455 | 11/1976 | Reggel et al. | 44/1 R |

FOREIGN PATENT DOCUMENTS

| | | | |
|---|---|---|---|
| 1,331,524 | 9/1973 | United Kingdom | 201/17 |

*Primary Examiner*—Carl F. Dees
*Attorney, Agent, or Firm*—McGlew and Tuttle

[57] ABSTRACT

A method of removing ash components from coals, particularly high-ash content coals, comprises grinding the coal into ground particles and suspending the ground coals in an aqueous alkali carbonate solution. The solution is maintained in a reactor for 45 to 120 minutes at a temperature range of from 250° to 280° C and under a pressure of from 50 to 80 atm in order to cause the $CO_2$ to be set free by dissociation. The $CO_2$ is discharged from the reactor by directing an inert gas stream through the reactor and discharging the $CO_2$ with the gas stream. The suspension is stirred and agitated at elevated temperatures and increased pressures in order to fuse the ashes. The aqueous solution containing the dissolved ash components is then separated from the coal. The removed carbon dioxide is introduced into a solution for reforming the alkali carbonate in order to cause the contents of the solution to become insoluble and separated and the alkali solution to become regenerated. The regenerated solution is then used to continue the operation by forming a further aqueous alkali carbonate solution and ground coal suspension.

15 Claims, 1 Drawing Figure

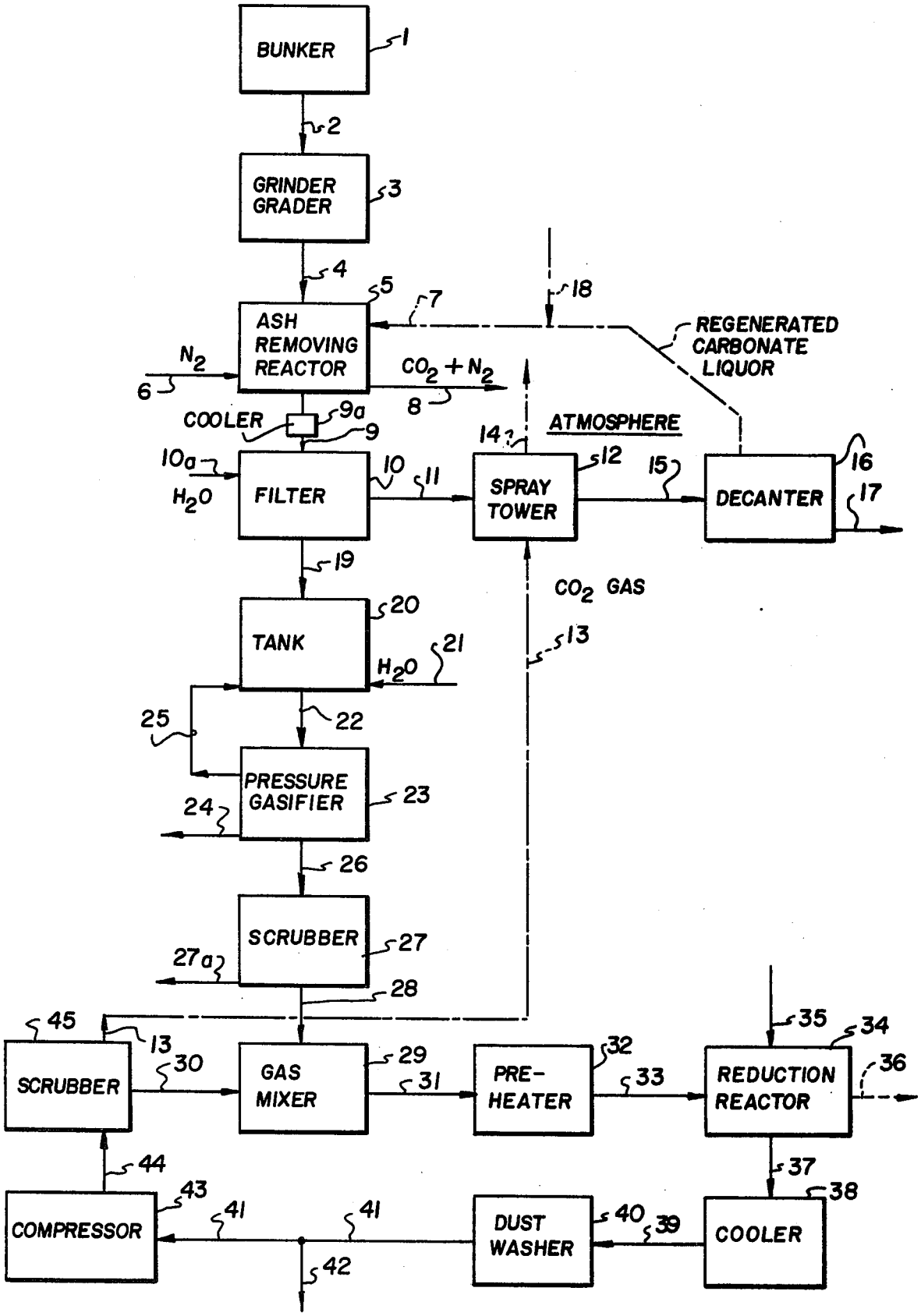
BUNKER
1
2
GRINDER GRADER
3
4
5
7
18
ASH REMOVING REACTOR
REGENERATED CARBONATE LIQUOR
$N_2$
6
$CO_2 + N_2$
8
COOLER
9a
9
ATMOSPHERE
14
10a
$H_2O$
FILTER
10
11
SPRAY TOWER
12
15
DECANTER
16
17
19
$CO_2$ GAS
20
TANK
21
13
$H_2O$
25
22
PRESSURE GASIFIER
23
24
26
SCRUBBER
27
27a
28
45
13
35
34
SCRUBBER
30
GAS MIXER
29
31
PRE-HEATER
32
33
REDUCTION REACTOR
36
44
37
43
38
COMPRESSOR
41
41
DUST WASHER
40
39
COOLER
42

METHOD OF REMOVING ASH COMPONENTS FROM HIGH-ASH CONTENT COALS

FIELD AND BACKGROUND OF THE INVENTION

This invention relates in general to methods of removing ash from coals and, in particular, to a new and useful method of removing ash components from high-ash content coal in which the ground coal is suspended in an aqueous alkali carbonate solution.

DESCRIPTION OF THE PRIOR ART

The present invention relates to a method of removing ash components from coals, particularly high-ash bituminous and sub-bituminous coals, in which the coals are ground, suspended in aqueous, alkaline-reacting, solutions and the ashes are fused at an elevated temperature and increased pressure under stirring motion and, thereupon, the coals are separated from the aqueous extract.

A method is known from "BIOS FINAL REPORT 522, item 30," in which the fine coal, freed in advance from a part of its ashes in a flotation process, is mixed with 5.6 times the amount of a 2.5 percent sodium hydroxide solution, the suspension is kept for 20 minutes under 100 to 200 atm at 250° C, the liquor is then separated and the coal is washed with water and hydrochloric acid. For this purpose, 140 kg of caustic soda are needed per metric ton of coal.

From U.S. Pat. No. 2,556,496, there is further known an ash removal process in which the coal is extracted at temperatures between 120° and 130° C, with a mixture of aqueous sodium hydroxide solution and butanol and is subsequently washed with water and hydrochloric acid.

A hydrolysis of coals is known from the reference "Ind. Engng. Chem. 47 (8), page 1586 (1955)," in which fine coals are fused for 24 hours with a 5n sodium hydroxide solution at 350° C under an increased pressure of nitrogen as a protective gas.

Since these methods for the most part require large amounts of the relatively expensive caustic soda, with no possibility of recovery, they have not prevailed in the industry.

SUMMARY OF THE INVENTION

The present invention is directed to a method of removing ash components which can be carried out with a less expensive alkali chemical and which in addition makes it possible to regenerate and reuse this chemical in the same process.

In accordance with the invention, the ground coal is suspended in an aqueous alkali carbonate solution and the suspension is kept under agitation or stirring motion for 60 to 120 minutes at 250° to 280° C and under a pressure of 50 to 80 atm, during which period of time, the $CO_2$, set free by dissociation, is discharged by a stream of inert gas. Thereupon, the aqueous solution containing the dissolved ash components is separated from the coal and $CO_2$ is introduced into the solution for reforming alkali carbonate, the content thereby rendered insoluble is separated and, in the alkali carbonate solution, fine coal is again suspended and the ashes are fused.

A potassium or sodium carbonate solution is suitable for the initial run for the alkali carbonate solution to be used in the process. The alkali carbonate solution is used in a form which is as concentrated as possible. At 100° C, a trinormal sodium carbonate solution or a hexanormal potassium carbonate solution, for example, is still sufficiently far from its saturation so as to be able to be handled in the inventive method. The fine coal to be used may be freed from a part of its ash content in advance by a flotation treatment.

The operational conditions applied may vary within large limits and depend on the varying compositions of the coal ashes.

In a preferred variant of the method which is applicable to many varieties of coals, there is used, for example, a trinormal sodium carbonate solution in an amount such that the ash-to-carbonate weight ratio obtained is 2 : 4, and the suspension is treated for 45 to 90 minutes at 250° to 280° C and under a pressure of 50 to 80 atm. Nitrogen is particularly suitable as the inert discharge gas.

It is advisable to keep the partial pressure of the $CO_2$ to 3 to 5 atm. At this pressure, the hydrolysis seems to be particularly supported, which is manifested by the high pH value of the aqueous phase.

The $CO_2$ which is set free at the beginning of the fusion may be collected and used again for the re-formation of the alkali carbonate. It is also possible, however, to employ $CO_2$ from foreign sources, such as, for example, in accordance with a further provision, the $CO_2$-containing waste gases of a plant for a direct reduction of ores, particularly iron ores (German patent Application No. P 25 27 097.7). In this way, a single or double coupling of technological processes is carried out where, first, the coal is pretreated and the ash removal is gasified to serve as the reduction gas for the ore and, second, the waste gas of the ore reducing process is used as the $CO_2$ source for regenerating the solution of the coal ash removing process.

The regeneration of the alkali carbonate solution is again advantageously carried out under pressure. Pressures of between from 50 and 80 atm have proven satisfactory and purposeful in this respect. The method is suitable primarily for bituminous coal and also for older sub-bituminous coals.

With the inventive method, it is possible to reduce the ash content, for example, of 40 to 12%.

Accordingly, it is an object of the invention to provide an improved method of removing ash components from coal in which the coal is ground into ground particles and suspended in an aqueous carbonate solution and wherein the solution is maintained in a reactor for 45 to 120 minutes at a temperature range of from 250° to 280° C under a pressure of from 50 to 80 atm in order to cause the $CO_2$ to be set free by dissociation and which is subsequently discharged from the reactor and in which the solution is then stirred and agitated at elevated temperatures and pressures in order to fuse the ashes and then separating the aqueous solution containing the dissolved ash components from the coal and further, introducing the removed $CO_2$ into a solution for reforming an alkali carbonate solution which is used for a further ground coal suspension.

A further object of the invention is to provide a method of removing ash components from high-ash content coals which is easy to carry out, relatively inexpensive and which provides high yields and handles materials economically.

For an understanding of the principles of the invention, reference is made to the following description of a typical embodiment thereof as illustrated in the accompanying drawing.

BRIEF DESCRIPTION OF THE DRAWING

The only FIGURE of the drawing is a diagrammatic view of the apparatus for carrying out the method of the invention.

DESCRIPTION OF THE PREFERRED EMBODIMENT

Referring to the drawing in particular, the invention is carried out by using a raw coal which has an ash content of 40% and the ashes contain, as expressed in oxides, the following:

30% of $Al_2O_3$
45% of $SiO_2$
15% of $Fe_2O_3$
3% of CaO
4% of $K_2O$
4% of $Na_2O$

The raw coal is stored in a bunker 1 and delivered, by a conveying means 2, to a crushing and grading plant 3 where it is ground to such a degree of fineness that 40 to 50% of the grains have a diameter smaller than 44 microns. This fine coal suspension is supplied, through a line 4, to an ash-removing reactor 5 in which it is stirred with a double amount of a 3n soda solution fed in through a line 7, and heated, under a pressure of 60 bar, up to 280° C. Nitrogen is introduced into the coal-liquor suspension through a line 6. A mixture of nitrogen and carbon dioxide is removed and discharged into the free atomsphere through a line 8 outgoing from above the liquid surface. Should substantial amounts of hydrogen sulfide be contained in the waste gas, the gas is first passed through one of the well-known desulfurizing plants.

After a treatment period of 60 minutes, the coal-liquid suspension is cooled down to 90° C in a heat exchange cooler **9*a* and directed, through a line 9, to a filter 10 in which the coal substance, now containing only 20% of the initial ash content, is separated from the aqueous liquor and rewashed with water from a line 10*a***.

The separated liquor with the dissolved ash components which are present, for example, silicates, aluminates, ferrates, etc., as well as the washings, are drawn off from filter 10 through a line 11 and conveyed to a carbonizing spray tower 12 where they are exposed at 150° C and 20 bar to the action of $CO_2$-containing gases which are directed through a line 13. During this treatment with gas, water is vaporized and the aqueous liquor is thickened. Residual gases containing mainly water vapor and carbon dioxide are drawn off through a line 14 into the free atmosphere.

Now the carbonized liquor contains not only the soluble alkali carbonates, but also insoluble ash components, such as silica, aluminum and iron carbonates, etc., and is supplied to a decanter 16 through a line 15. The separated insoluble content is drained as ash sludge through a line 17 and the regenerated carbonate liquor is recycled to ash-removal reactor 5 through line 7. Line 18 serves the purpose of supplying carbonate or hydroxide solutions as a compensation for losses in carbonate liquor. These losses represent about 0.5% of the entire circulated liquor amount.

The filtered and washed pure coal is conveyed into a tank 20 through a line 19 where a coal suspension is produced by adding soft water supplied through a line 21. The necessary stirrers, pumps, and heaters are not shown. The suspension is directed through a line 22 to an oxygen pressure gasifier 23 of well-known construction. The residual ashes of the pure coal are discharged through a line 24 and non-gasified carbon in the form of coke or soot is recycled through a line 25 into tank 20. The gas of the gasification is drawn off through a line 26 and stripped from $CO_2$ and $H_2S$ in a scrubber 27. The scrubbed out $CO_2$ and $H_2S$-containing gases are directed through a line **27*a* for further treatment. The cleaned gasification gas passes through a line 28 into a gas mixer 29 of an iron ore gas reduction plant. In gas mixer 29, the fresh gasification gas is mixed with the circulating gas of the ore reduction plant which has been stripped from carbon dioxide and is fed into gas mixer 29 through a line 30. The mixed gas now passes through a line 31 into a preheater 32 and, from there, through a line 33, into a reduction reactor 34 which is supplied with oxide iron ore through a feed line 35. Iron sponge is removed from reduction reactor 34 through a line 36 and the gas through the line 37 and passed into a steam-producing cooler 38 and from there through a line 39 into a dust washer 40**.

The gas freed from dust is removed from the circuit through a line 41 and a part thereof through a line 42 for heating purposes (for example, for the ash-removing reactor 5, or the preheater 32 of the reduction gas) and for controlling the inert content. The first part of the cooled, dust-free, reduction gas, enriched with $CO_2$, passes into a compressor 43. The compressed gas is directed through a line 44 into a $CO_2$ scrubber 45 and, with the $CO_2$ stripped, the clean reduction gas passes through a line 30 to the gas mixer 29 where it is mixed with fresh gasification gas and is recycled into the ore reducing reactor 34. The scrubbed $CO_2$-containing gases are drawn off through line 13 and pass to the carbonizing tower 12. The ash-removing system is connected to the reduction system through line 13 and the gasification plant is connected to the reduction plant through lines 28.

While a specific embodiment of the invention has been shown and described in detail to illustrate the application of the principles of the invention, it will be understood that the invention may be embodied otherwise without departing from such principles.

What is claimed is:

1. A method of removing ash components from coals, particularly high ash content coals, comprising grinding the coal into ground particles, suspending the ground coal in an aqueous alkali carbonate solution to form a coal liquor suspension, maintaining said suspension in a reactor for from 45 to 120 minutes at a temperature range of from 250° C to 280° C under a pressure of from 50 to 80 atm in order to cause the $CO_2$ to be set free by dissociation, discharging the free $CO_2$ by directing an inert gas stream through the reactor and discharging the stream plus the free $CO_2$ from the reactor, cooling said coal liquor suspension, stirring and agitating the suspension at elevated temperatues and at increased pressures in order to fuse the ashes, separating the aqueous solution with the dissolved ash components from the coal, introducing the removed $CO_2$ into a solution for reforming the alkali carbonate to cause the contents of the solution to become insoluble and separated and causing the alkali solution to become regenerated, using the regenerated alkali solution once again as an aqueous alkali carbonate solution for suspending ground coal.

2. A method of removing ash components from coals, according to claim 1, wherein sodium carbonate solution is the alkali carbonate solution used for dissolving the ash components.

3. A method of removing ash components from coals, according to claim 1, wherein a 3N sodium carbonate solution is the alkali carbonate solution used for dissolving the ash components.

4. A method of removing ash components from coals, according to claim 1, wherein 2 to 4 kg of $Na_2CO_3$ per kg of ashes are used as the alkali carbonate solution.

5. A method of removing ash components from coals, according to claim 1, wherein a 6N potassium carbonate solution is used as the alkali carbonate solution for dissolving the ash components.

6. A method of removing ash components from coals, according to claim 1, wherein prior to suspending the coal, it is ground and then suspended in a liquid to remove the ash contents by a flotation process.

7. A method of removing ash components from coals, according to claim 1, wherein nitrogen is used as an inert gas for removing the $CO_2$ from said reactor.

8. A method of removing ash components from coals, according to claim 1, wherein for dissolving the ash components, a $CO_2$ partial pressure of from 3 to 5 atm is adjusted.

9. A method of removing ash components from coals, according to claim 1, wherein the $CO_2$ set free by dissociation of the alkali carbonates is added in the regeneration of the alkali carbonate solution.

10. A method of removing ash components from coals, according to claim 1, wherein $CO_2$ from foreign processes is used in the regeneration of the alkali carbonate solution.

11. A method of removing ash components from coals, according to claim 1, wherein $CO_2$-containing gases separated from the reduction gas circuit in an iron reducing process are used in the regeneration of the alkali carbonate solution.

12. A method of removing ash components from coals, particularly, high-ash content coals comprising grinding the coal into ground particles, suspending the ground coal in an aqueous carbonate solution to form a coal liquor suspension, maintaining said coal liquor suspension in a reactor from 45 to 120 minutes at a temperature in the range from 250° to 280° C under a pressure of 50 to 80 atm causing $CO_2$ to be set free by dissociation, directing a stream of inert gas through the reactor to mix with the free $CO_2$ whereby the $CO_2$ is discharged from the reactor with said inert gas stream, cooling the coal liquor suspension, separating acqueous liquor of said coal liquor suspension from the coal therein whereby said separated aqueous liquor contains dissolved ash components, directing said separated aqueous liquor with dissolved ash component to a spray tower whereby said separated aqueous liquor is exposed to gases containing $CO_2$ at elevated temperature and pressures to carbonize said liquor, separating the insoluble ash components from the soluble alkali carbonates of said carbonized liquor, and recycling the carbonized liquor to said reactor to form a coal liquor suspension on said reactor.

13. A method of removing ash components from coal, according to claim 12 and including the step of gasifying the separated coal whereby the gases of said gasification are directed to an ore gas reducing process.

14. A method of removing ash components from coal according to claim 13 and including the step of stripping the $CO_2$ from the reduction gases generated by said ore gas reducing process, and directing said stripped $CO_2$ to said spray tower for effecting the carbonization of said separated aqueous liquor.

15. A method of removing ash components from coal according to claim 14 and including the step of compressing the reduction gases generated by said ore gas reduction process, separating the $CO_2$ from said compressed gases, and mixing the compressed gases free of $CO_2$ with the gases generated by the gasification of said separated coal, and directing said mixed gases to said reduction process.

* * * * *